US008042844B2

(12) United States Patent
Benhammou

(10) Patent No.: US 8,042,844 B2
(45) Date of Patent: Oct. 25, 2011

(54) PROFILED SECTION FOR DOOR OR BAY FRAME

(75) Inventor: Jacob Benhammou, La Queue en Brie (FR)

(73) Assignee: Digit, Pantin (FR)

( * ) Notice: Subject to any disclaimer, the term of this patent is extended or adjusted under 35 U.S.C. 154(b) by 0 days.

(21) Appl. No.: 11/124,358

(22) Filed: May 9, 2005

(65) Prior Publication Data

US 2005/0204518 A1 Sep. 22, 2005

Related U.S. Application Data

(63) Continuation of application No. PCT/FR2003/002983, filed on Oct. 10, 2003.

(30) Foreign Application Priority Data

Nov. 19, 2002 (FR) ..... 02 14432

(51) Int. Cl.
*E05C 17/56* (2006.01)
*E05C 19/16* (2006.01)

(52) U.S. Cl. ..... 292/251.5; 52/204.1; 52/656.4; 52/834; 49/394

(58) Field of Classification Search ..... 292/251, 292/251.5, DIG. 72; 49/394, 449; 52/204.1, 52/656.4, 656.5, 656.6, 834, 843
See application file for complete search history.

(56) References Cited

U.S. PATENT DOCUMENTS

| | | | | | |
|---|---|---|---|---|---|
| 2,153,080 | A * | 4/1939 | Flora | 292/341.19 |
| 3,204,154 | A * | 8/1965 | Crandell | 335/289 |
| 3,782,146 | A * | 1/1974 | Franke | 70/232 |
| 4,306,744 | A * | 12/1981 | Krehbiel | 292/144 |
| 4,562,665 | A * | 1/1986 | Blackston | 49/44 |
| 4,831,781 | A * | 5/1989 | Morton | 49/504 |
| 5,016,929 | A * | 5/1991 | Frolov | 292/251.5 |
| 5,069,047 | A * | 12/1991 | Lynch et al. | 70/57.1 |
| 5,372,020 | A * | 12/1994 | Stoltz et al. | 70/57.1 |
| 5,376,910 | A * | 12/1994 | Geringer et al. | 335/278 |
| 5,573,317 | A * | 11/1996 | Cavanaugh et al. | 312/7.2 |
| 5,610,794 | A * | 3/1997 | Dye et al. | 361/206 |
| 5,641,187 | A * | 6/1997 | Frolov | 292/251.5 |
| 6,053,546 | A * | 4/2000 | Frolov | 292/251.5 |
| 6,192,643 | B1 * | 2/2001 | Zadok | 52/648.1 |
| 6,609,738 | B1 * | 8/2003 | Roth et al. | 292/251.5 |
| 7,164,337 | B1 * | 1/2007 | Furia | 335/285 |

FOREIGN PATENT DOCUMENTS

| | | |
|---|---|---|
| EP | 0010763 | 5/1981 |
| FR | 2111301 | 6/1972 |
| FR | 2654143 | 5/1991 |

* cited by examiner

*Primary Examiner* — Carlos Lugo
*Assistant Examiner* — Mark Williams
(74) *Attorney, Agent, or Firm* — Greenblum & Bernstein, P.L.C.

(57) ABSTRACT

A profiled section includes a first surface and a second surface, such that the second surface has an opening to at least partially receive an element of a locking member. The wing is structured and arranged parallel to the second surface. Further, an element is coupled to the first and second surfaces and to the wing. The instant abstract is neither intended to define the invention disclosed in this specification nor intended to limit the scope of the invention in any way.

21 Claims, 2 Drawing Sheets

PROFILED SECTION FOR DOOR OR BAY FRAME

CROSS-REFERENCE TO RELATED APPLICATIONS

The present application is a Continuation of International Patent Application No. PCT/FR2003/002983 filed Oct. 10, 2003, and claims priority of French Patent Application No. 02/14432 filed Nov. 19, 2002. Moreover, the disclosure of International Patent Application No. PCT/FR2003/002983 is expressly incorporated by reference herein in its entirety.

BACKGROUND OF THE INVENTION

1. Field of the Invention

The present invention relates to a profiled section for a door or bay frame that enables the use of an electric lock called an "electromagnetic locking member".

A locking member is made of two parts, the locking member itself, made of a magnet, and a metallic counterplate made of soft iron. Each of these parts is nested in the profiled section, generally made of aluminum, and forming the frame which, for this purpose, has an appropriate aperture. The profiled sections used up until now have a tubular cross-section and two parallel surfaces. One of the major problems is to attach the counterplate, which must be floatingly mounted.

2. Background and Material Information

The prior art discloses a counterplate attached by a flexible mounting connection to a median portion of an intermediate piece. The intermediate piece is shaped as a stirrup, and attached to a profiled section at right angles with the counterplate entry aperture, such that a front screw or a screw jack is supported against the inner surface of the profiled section opposite the aperture.

This method is costly because it requires the manufacture of an intermediate piece that is difficult to position and attach. Moreover, the screw jacks tend to deform the visible surface of the profiled section which, in addition, must have a part that extends parallel to the opposing surface, preventing the visible surface of the profiled section from having an appealing appearance.

SUMMARY OF THE INVENTION

The present invention improves the profiled section that includes an intermediate wing on which the counterplate or the locking member can be attached.

The invention provides the profiled section having a first surface and a second surface, such that the second surface has an opening to at least partially receive an element of a locking member. The wing is structured and arranged parallel to the second surface. Further, an element is coupled to the first and second surfaces and to the wing.

According to another feature of the invention the profiled section can be tubular. Further, the element of a locking member is an element of an electromagnetic locking member, and the element of a locking member can be a counterplate. The wing may include two lateral portions and a median portion, such that the median portion is thicker than the lateral portions. The wing can further include one or more recesses. Further still, the wing is coupled to the element of a locking member by at least one of a screw, a screw jack, and a flexible mounting element.

According to another feature of the invention is an apparatus for a door or bay frame having a first surface and a second surface, wherein the second surface has an opening. Further, the wing is structured and arranged to be parallel to the second surface. The counterplate is at least partially positioned in the opening and movably attached to the wing. At least one element is coupled to the first and second surfaces, as well as the wing. Further still, the counterplate is at least one element of an electromagnetic locking member. The wing includes at least one lateral portion and a median portion, such that the median portion is thicker than the lateral portion. The wing can be couplable to the counterplate by at least one of a screw, a screw jack, and a flexible mounting element.

According to another feature of the invention is an apparatus for a door or bay frame having a first surface and a second surface, wherein the second surface has an opening. The wing is structured and arranged parallel to the second surface. The counterplate is at least partially positioned in the opening and movably coupled to the wing. Wherein the wing is arranged to prevent deforming of the first surface from forces exerted on the counterplate. Further, the apparatus is adapted to receive an electromagnetic locking member, such that the counterplate is at least one element of said electromagnetic locking member. The apparatus may be tubular in shape. The wing can include one or more portions, such that one portion has a varying thickness parallel to the second surface. The wing may include one or more recess. Further, the wing is couplable to the counterplate by at least one of a screw, a screw jack, and a flexible mounting element. Further still, the first surface can be structured and arranged as a handle.

Other exemplary embodiments and advantages of the present invention may be ascertained by reviewing the present disclosure and the accompanying drawing.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
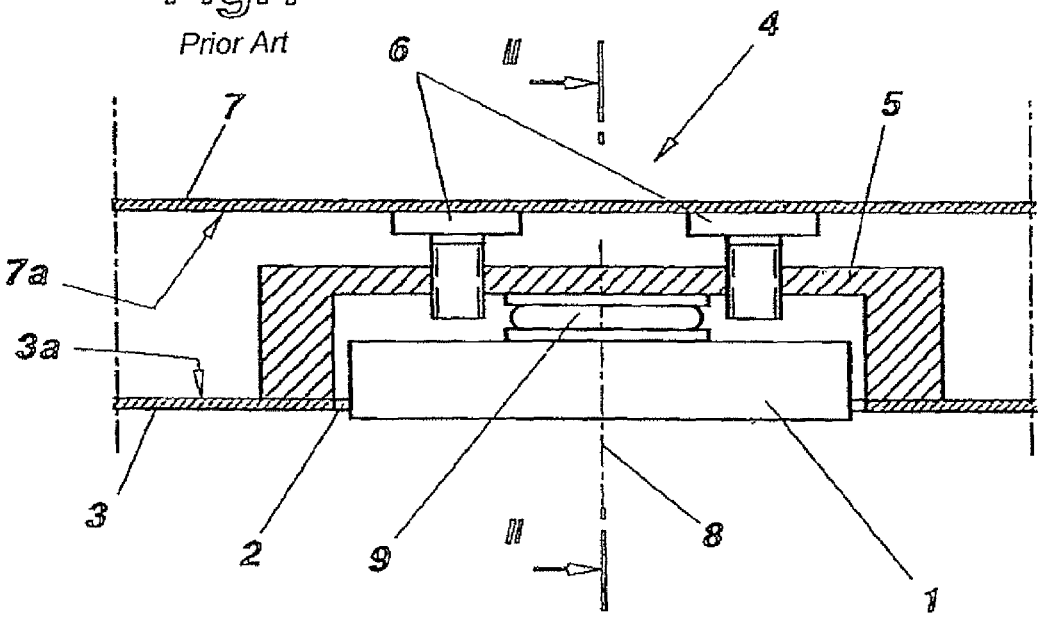
Fig. 1 Prior Art
FIG. 1 A longitudinal cross-sectional view, showing the attachment of a conventional counterplate in a profiled section.
Figure 2:
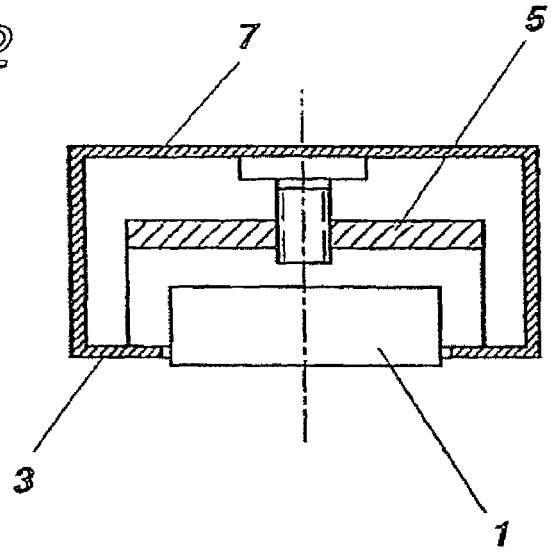
Fig. 2 Prior Art
FIG. 2 A cross-sectional view along the line II-II of FIG. 1.

FIGS. 1 and 2 show by way of example profile structures that can be embodied of a conventional counterplate 1 retained in the aperture 2 of the surface 3 of a profiled section 4. A stirrup 5 includes sides applied against the inner surface 3*a* of the surface 3, such that screw jacks 6 are supported against the inner surface 7*a* of the surface 7, opposite surface 3. The counterplate 1 is retained against the median portion of the stirrup by at least one screw, defined by axis 8, with insertion of a flexible mounting 9. The above device is costly because it requires the manufacture of a stirrup 5 that is difficult to position in the profiled section. In addition, the pressure exerted by the screws 6 tends to deform the visible surface 7 of the profiled section.

Figure 3:
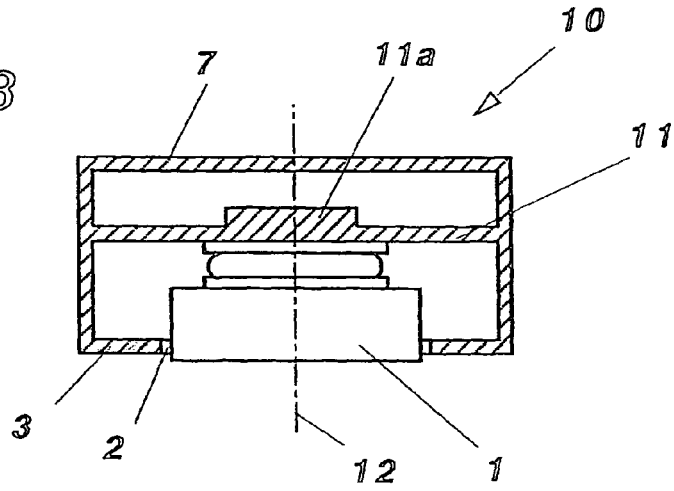
FIG. 3 A profiled section according to the invention.

FIG. 3 discloses an example of the present invention showing a profiled section 10 having a wing 11 extending between the surfaces 3 and 7, such that the counterplate 1 is attached by at least one screw, represented schematically by the axis 12. One embodiment of the present invention discloses the median portion 11*a* of the wing 11 reinforced, such that the medium portion is thicker than the lateral portions. According to the invention, the wing 11 surface is parallel to the surface 3.

According to the invention, FIG. 3 discloses wing 11 structured and arranged to withstand forces holding the counterplate of the profiled section, so as not to deform and/or impair the appealing appearance of surface 7. In particular, at least one screw holds the counterplate to the reinforced portion wing 11*a*, as represented schematically by axis 12. Note, the disadvantages of prior art disclose surface 7 subject to forces from screw jacks holding the counterplate, resulting in possibly deforming and impairing the appealing appearance of surface 7. Moreover, the present invention discloses an attachment of the counterplate to the wing 11 which allows for a more appealing appearance to surface 7 over the prior art, along with the wings intended use.

Figure 4:
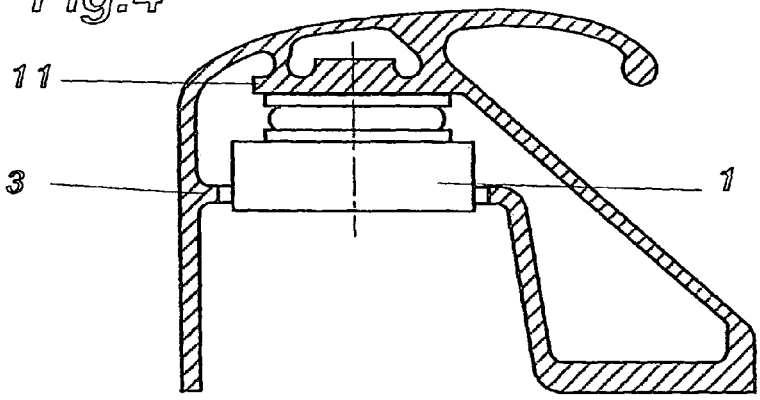
FIG. 4 A profiled section of an alternate embodiment according to the invention.
Figure 5:
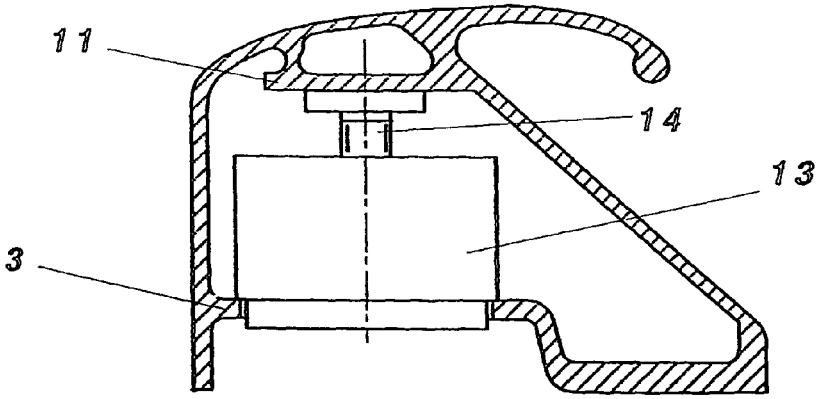
FIG. 5 A profiled section of an alternate embodiment according to the invention.

FIG. 4 shows an example of a profiled section according to the invention, that can be used as a handle. FIG. 5 shows an example of a profiled section which enables the retention of a conventional locking member 13, such that the wing 11 is used to support the conventional screw jacks 14.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A door or bay frame profiled section comprising:

at least one element of a locking member, the at least one element of the locking member comprises an element of an electromagnetic locking member for locking and unlocking the profile section to an adjacent door or frame;

a wall having an opening structured and arranged to at least partially receive the at least one element of a locking member;

the wall comprising wall portions arranged on opposite sides of the opening;

at least one wing arranged parallel to said wall such that the wall portions of the wall on opposite sides of the opening are parallel to the at least one wing;

the at least one element of the locking member having a rear end directly coupled to the at least one wing via a mounting device and a front end which extends into the opening;

a first surface arranged on an other wall;

the at least one wing being arranged between the wall and the other wall;

a connecting wall directly coupled to said other wall, to said wall and to said wing; and the connecting wall being spaced from an edge of the opening by one of the wall portions, wherein the door or bay frame profiled section is arranged on a door or bay frame.

2. The profiled section in accordance with claim 1, wherein the profiled section is tubular.

3. The profiled section in accordance with claim 1, wherein said element of said electromagnetic locking member is a counterplate.

4. The profiled section in accordance with claim 1, wherein said at least one wing comprises two lateral portions and a median portion that is thicker than said lateral portions.

5. The profiled section in accordance with claim 1, wherein said at least one wing includes one or more recess.

6. The profiled section in accordance with claim 1, wherein said mounting device comprises at least one of a screw, a screw jack, and a flexible mounting element.

7. The profiled section in accordance with claim 1, wherein a second connecting wall is arranged on an opposite sides of the opening from the connecting wall such that each of the two connecting walls is spaced from an edge of the opening by one of the wall portions, and wherein said at least one wing being spaced apart from said first surface by a first amount and wherein said at least one wing being spaced apart from each said connecting wall by a second amount that is greater than the first amount.

8. The profiled section in accordance with claim 1, wherein a second connecting wall is arranged on an opposite side of the opening such that each of the two connecting walls is spaced from an edge of the opening by one of the wall portions, and wherein the first surface, each of the connecting walls, and the at least one wing are arranged on a one-piece member, wherein each said wall portion has a first side which faces the at least one wing and an opposite side and wherein the at least one element of a locking member has a surface which projects out past the opposite side.

9. The apparatus in accordance with claim 1, wherein a second connecting wall is arranged on an opposite side of the opening such that each of the two connecting walls is spaced from an edge of the opening by one of the wall portions, wherein each said wall portion has a first side which faces the at least one wing and an opposite side and wherein the at least one element of a locking member has a surface which projects out past the opposite side.

10. An apparatus for a door or bay frame comprising:

a wall having an opening;

the wall comprising wall portions arranged on opposite sides of the opening;

at least one wing is parallel to said wall such that the wall portions of the wall on opposite sides of the opening are parallel to the at least one wing;

at least one counterplate at least partially positioned in said opening and movably attached to said at least one wing;

the at least one counterplate having a rear end connected to the at least one wing via a mounting device and a front end which extends into the opening;

a first surface arranged on an other wall and that is visible when the apparatus is installed on the door or bay frame;

the at least one wing being arranged between the wall and the other wall;

a connecting wall directly coupled to said first surface, to said wall and to said at least one wing;

the connecting wall being spaced from an edge of the opening by one of the wall portions; and the wall, the other wall, the at least one wing and the connecting wall being arranged on a one-piece member, wherein the apparatus is arranged on the door or bay frame, and wherein said at least one counterplate is at least one element of an electromagnetic locking member for locking and unlocking the profile section to an adjacent door or frame.

11. The apparatus in accordance with claim 10, wherein said at least one wing comprises at least one lateral portion and a median portion, such that said median portion is thicker than said at least one lateral portion.

12. The apparatus in accordance with claim 10, wherein said mounting device comprises at least one of a screw, a screw jack, and a flexible mounting element.

13. The apparatus in accordance with claim 10, wherein a second connecting wall is arranged on an opposite side of the opening from the connecting wall such that each of the two connecting walls is spaced from an edge of the opening by one of the wall portions, and wherein said at least one wing being spaced apart from said first surface by a first amount and wherein said at least one wing being spaced apart from each said connecting wall by a second amount that is greater than the first amount.

14. An apparatus for a door or bay frame comprising:

a wall having an opening;

at least one wing is structured and arranged parallel to said wall and spaced apart from a first surface;

the wall comprising wall portions arranged on opposite sides of the opening;

the wall portions of the wall on opposite sides of the opening being parallel to the at least one wing;

at least one counterplate is at least partially positioned in said opening and movably coupled to said at least one wing;

the at least one counterplate having a rear end connected to the at least one wing via a mounting device and a front end which extends into the opening;

the first surface arranged on an other wall;

the at least one wing being arranged between the wall and the other wall;

a first connecting wall directly coupled to said other wall, to said wall and to said at least one wing;

a second connecting wall directly coupled to said other wall, to said wall and to said at least one wing; and each of the first and second connecting walls being spaced from an edge of the opening by one of the wall portions, wherein said wing is arranged to prevent deforming of said first surface from forces exerted on said at least one counterplate, and wherein the apparatus is arranged on the door or bay frame, wherein the apparatus is adapted to receive an electromagnetic locking member, and wherein said counterplate is at least one element of said electromagnetic locking member for locking and unlocking the profile section to an adjacent door or frame.

15. The apparatus in accordance with claim 14, wherein the wall, other wall, the at least one wing and the first and second connecting walls comprise a one-piece profiled section that is tubular.

16. The apparatus in accordance with claim 14, wherein said at least one wing has one or more portions, such that said at least one portion has a varying thickness parallel to said second surface.

17. The apparatus in accordance with claim 14, wherein said at least one wing includes one or more recess.

18. The apparatus in accordance with claim 14, wherein said mounting device comprises at least one of a screw, a screw jack, and a flexible mounting element.

19. The apparatus in accordance with claim 14, wherein said first surface is structured and arranged as a handle.

20. The apparatus in accordance with claim 14, wherein said at least one wing being spaced apart from said first surface by a first amount and wherein said at least one wing being spaced apart from said wall by a second amount that is greater than the first amount.

21. The apparatus in accordance with claim 14, wherein the first surface, the wall and the at least one wing are arranged on a one-piece member, wherein said wall has a first side which faces the at least one wing and an opposite side and wherein the at least one element of a locking member has a surface which projects out past the opposite side.

* * * * *